US005823041A

United States Patent [19]

McClung

[11] Patent Number: 5,823,041

[45] Date of Patent: Oct. 20, 1998

[54] METHOD AND APPARATUS FOR MAKING A NON-CYLINDRICAL CAN BODY

[75] Inventor: James A. McClung, North Canton, Ohio

[73] Assignee: Can Industry Products, Inc., Canton, Ohio

[21] Appl. No.: 870,543

[22] Filed: Jun. 6, 1997

[51] Int. Cl.[6] ..... B21D 22/26

[52] U.S. Cl. ..... 72/349; 72/361; 72/379.4

[58] Field of Search ..... 72/329, 348, 349, 72/361, 379.4, 336; 198/394, 399, 416

[56] References Cited

U.S. PATENT DOCUMENTS

| | | | |
|---|---|---|---|
| 948,818 | 2/1910 | Lindholm | 72/361 |
| 2,529,603 | 11/1950 | Galt | 198/399 |
| 4,454,743 | 6/1984 | Bulso, Jr. et al. | 72/361 |
| 4,711,611 | 12/1987 | Bachmann et al. | 413/69 |
| 5,052,207 | 10/1991 | Porucznik | 72/379.4 |
| 5,282,306 | 2/1994 | Katsuhiro et al. | 72/379.4 |
| 5,626,048 | 5/1997 | McClung | 72/336 |

*Primary Examiner*—Lowell A. Larson
*Attorney, Agent, or Firm*—Sand & Sebolt

[57] ABSTRACT

Method and apparatus for forming a non-cylindrical can body having a bottom wall and a side wall from an elongated flat strip of sheet metal having a known grain orientation. A non-circular blank is formed from the metal strip in a first forming press with the grain extending in a known direction. The blank is drawn by the press into a non-cylindrical can blank with the grain direction being known in the bottom wall of the can blank. The can blank is moved toward a second press and is oriented automatically as it passes through an orienting station so the direction of the grain is known when entering the second press. The can blank is redrawn to form a non-cylindrical can body with a known grain direction in the bottom wall of the can body by maintaining the orientation of the can blank as it is drawn and redrawn in the second press.

16 Claims, 4 Drawing Sheets

DRAW STATION

METHOD AND APPARATUS FOR MAKING A NON-CYLINDRICAL CAN BODY

BACKGROUND OF THE INVENTION

1. Technical Field

The invention relates to an improved method and apparatus for making non-cylindrical can bodies, preferably rectangular-shaped can bodies, such as used for the packaging of meat products. Even more particularly, the invention relates to such a can body in which the grain direction of the sheet metal strip from which the can body is formed is known and oriented and maintained in a known direction throughout the manufacture of the can body thereby preventing unnecessary wrinkling and thinning of the metal when making non-cylindrical-shaped can bodies and enabling the tooling to be more precisely designed and controlled.

2. Background Information

Upon the rolling of sheet metal strips, such as used in the making of metal cans, the grain of the strip is established in the longitudinal direction since the strip is considerably greater in length than width and is passed between forming rolls during its manufacture. It is important during the subsequent drawing and redrawing of the metal when forming the can bodies that the grain have a certain orientation to provide the desired metal flow direction and control. This is especially critical when making non-cylindrical can bodies, such as the generally oval-shaped or rectangular-shaped can bodies used for containing meat products, such as sold and distributed under the trademarks SPAM and TREET.

In the prior art can-making methods and apparatus, a small dimple is formed off center in the bottom of the non-cylindrical can body, which is subsequently used throughout the manufacturing process to orient the can body in the correct grain direction. Although this orienting dimple provides for a satisfactory solution, it does leave an undesirable indentation in the can body which can be a problem, especially if the metal strip has been precoated and finished with a food grade coating.

It is also important that the grain direction in the strip and can body be properly oriented since it enables a much better control of the tooling and provides greater consistency in the final product and enables the tooling geometry and pressure to be more accurately controlled when the grain direction is known.

Another important feature of knowing the grain direction of the metal when making a non-cylindrical can body is that it enables a process known as "distorted litho" to be used. Distorted litho is printing the desired graphics on the flat sheet of starting material in a distorted configuration so that when the metal is formed into the final can body, the printing and graphics are correct. This is not a great problem when the finished can is cylindrical but causes a great problem in a non-cylindrical can due to the diverse and often uncontrolled movement of the metal in various directions. Thus, it is desirable to be able to utilize distorted litho printing on the flat strip when making both cylindrical cans, as well as non-cylindrical cans, especially those having a relatively deep draw thereto.

It is also desirable to be able to correctly orient the grain direction of the metal stampings and, more important, maintain the orientation throughout the manufacturing process, especially in a manufacturing operation using draw and redraw operations, as opposed to a process requiring ironing which requires lubrication and the subsequent washing and cleaning of the lubricating fluids therefrom, which is not required in a manufacturing operation using draw/redraw procedures.

Therefore, it is desirable to provide a manufacturing method and apparatus for producing non-cylindrical cans more uniformly and consistently with better controlled tooling than heretofore possible by knowing and maintaining the grain orientation without the use of a special guide device on or in the metal itself, such as the prior art dimple orienting device.

SUMMARY OF THE INVENTION

Objectives of the invention include providing an improved method and apparatus for the making of non-cylindrical can bodies in which the grain direction in the initial sheet metal strip is known and is maintained and controlled throughout the manufacturing of the initial, intermediate and final blank to provide better control and design of the required tooling and to provide greater consistency throughout the manufacturing process.

A further objective of the invention is to provide such an improved method and apparatus in which the orientation of the grain direction is known and maintained throughout the manufacturing of the can body without requiring any additional distortion of the metal as heretofore required to provide correct orientation, thereby avoiding possible problem areas in the can body.

Another objective of the invention is to provide such a method and apparatus which enables sheet material to be precoated with a food grade coating and which can contain distorted litho, which heretofore had been extremely difficult in the production of non-cylindrical can bodies, by knowing and maintaining the orientation of the grain direction of the metal at all stages in the manufacturing operation, and particularly when the can body is formed using draw and redraw procedures for reshaping the metal without thinning, as occurs in a manufacturing process requiring ironing and thinning of the metal.

A still further objective of the invention is to provide such a method and apparatus in which the non-cylindrical can body is formed completely without any ironing of the metal being required, thereby eliminating the use of lubricants which must subsequently be removed and disposed of prior to use of the can bodies, especially when packaging food products.

Another objective of the invention is to provide such a method and apparatus in which multiple-stage tooling can be utilized in a usual single or double-stroke press for initially forming a disk blank, either circular or non-circular, which is then subsequently formed into a non-cylindrical can blank with the direction of grain in the bottom wall being known, which blanks are then subsequently conveyed along a conveyor in a controlled manner toward a draw/redraw press and, most importantly, in which the elongated can blanks are automatically oriented upon passing through an orientation station so that the grain direction in the bottom wall of the can blank is known upon the can blanks reaching the draw/redraw press where they are subsequently moved therethrough while maintaining the known orientation.

These objectives and advantages are obtained by the improved method of the invention, the general nature of which may be stated as a method for making a non-cylindrical can body which includes the steps of providing an elongated strip of sheet metal having a uniform thickness and having a known predetermined grain direction; forming a flat blank from the metal strip with the grain direction of said blank being known; forming the flat blank into an elongated can blank having generally major and minor axes and having a known predetermined grain direction at a first tooling station; moving said elongated can blank from the first tooling station toward a second tooling station; orienting said elongated can blank in a predetermined direction with respect to the grain when moving between said first and second tooling stations; and redrawing said elongated can blank into the can body at the second tooling station while maintaining and knowing the grain direction in the bottom wall.

These objectives and advantages are further obtained by the improved apparatus of the invention, the general nature of which may be stated as including, apparatus for forming a non-cylindrical can body in which first tooling means for forming a flat blank from the flat strip with the grain direction extending in the known direction; second tooling means for forming the flat blank into an elongated can blank having an elongated bottom wall with major and minor axes and a side wall, with said bottom wall having the grain extending in the known direction; third tooling means for redrawing the can blank into the non-cylindrical can body and maintaining the grain direction extending in the known direction in the bottom wall of said can body; means for moving the can blank from the first and second tooling means to the third tooling means; and means for orienting the can blank so the grain is extending in the known direction prior to redrawing said can blank.

BRIEF DESCRIPTION OF THE DRAWINGS

A preferred embodiment of the invention, illustrative of the best mode in which applicants have contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
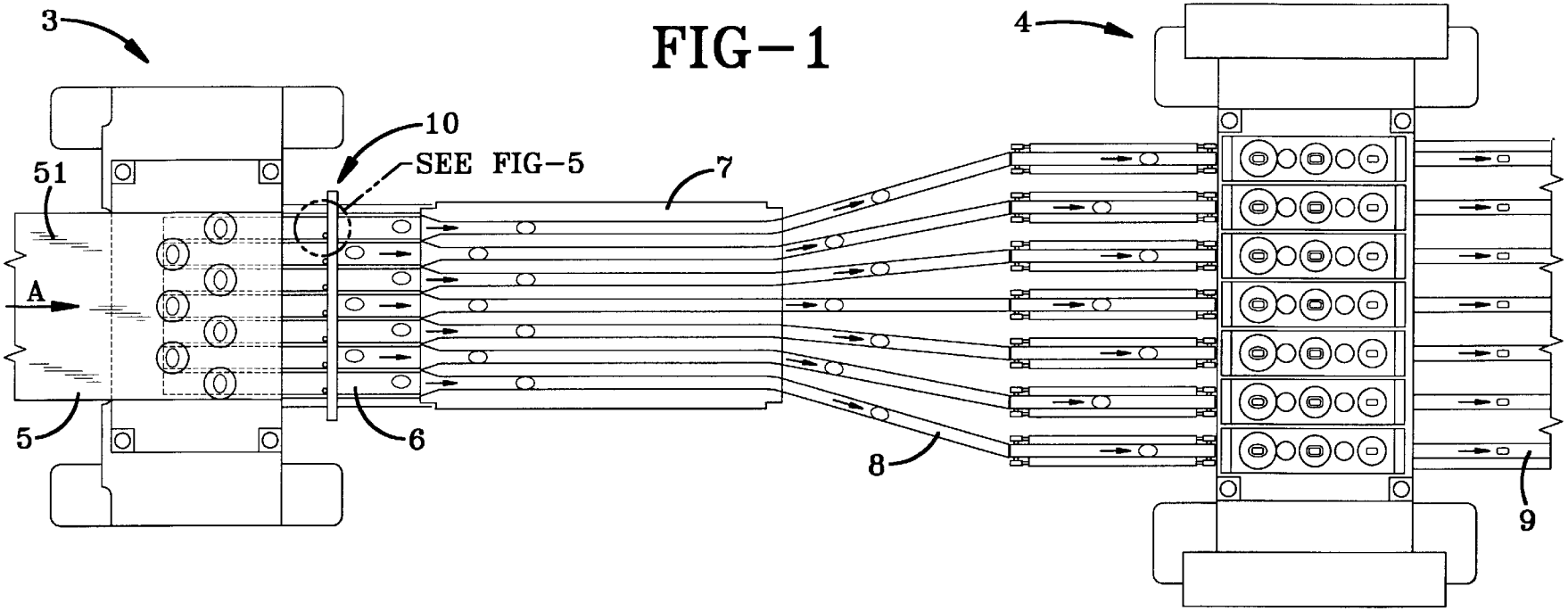
FIG. 1 is a diagrammatic top plan view showing the manufacturing sequence of producing an elongated can-shaped body from an input metallic strip to the can body output.

The method and apparatus of the present invention is shown diagrammatically in FIG. 1 and includes as the main components first and second tooling stations, indicated generally at 3 and 4, respectively, an incoming strip of sheet metal 5, output conveyors 6, transfer conveyors 7, another plurality of input conveyors 8 and output conveyors 9. In accordance with one of the main features of the invention, an orienting station 10 is located generally adjacent first tooling station 3 and extends across and is communication with the first output conveyors 6.

Figure 2:
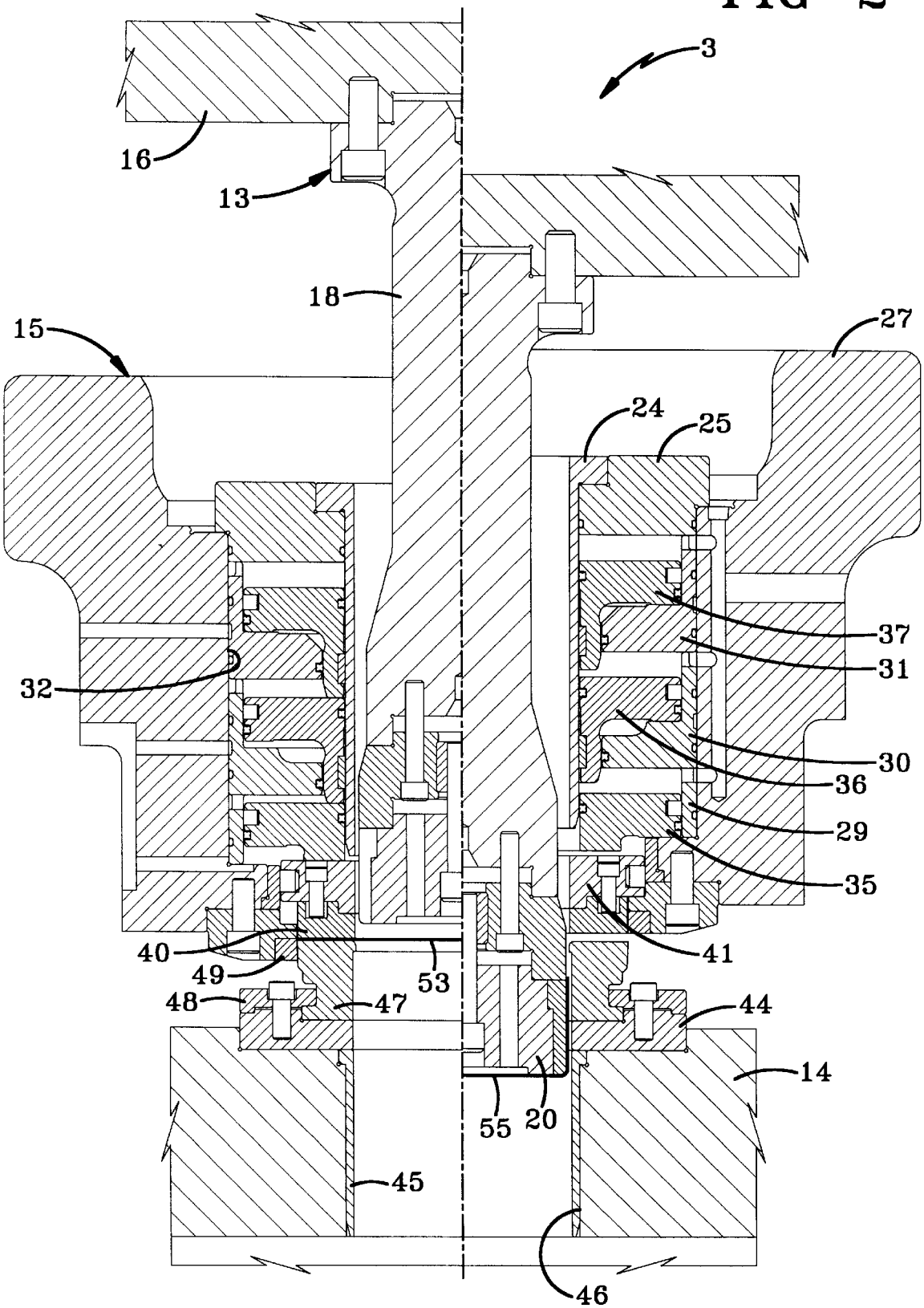
FIG. 2 is a diagrammatic sectional view of the blanking and can blank station tooling for forming the initial can blank, as shown in FIG. 4.

First tooling station 3 is shown in detail in FIG. 2 and preferably is a double-acting press, as is well known in the metal-stamping art, which is exemplified generally in U.S. Pat. No. 3,920,318, and may be of the further defined type, as shown in U.S. Pat. No. 5,636,048. Press 3 includes an inner ram 13 which is movable toward and away from a fixed base 14 and an outer ram 15. Inner ram 13 engages an inner punch holder 16 which is connected to an inner punch riser 18. Two die assemblies are connected to inner ram 13 and outer ram 15, as are found in most presses and associated dies, are therefore referred to generally and are well known to anyone skilled in the art.

A draw horn 20 is mounted to inner punch riser 18 and will move therewith in a reciprocal vertical direction upon movement of inner ram 13. A cylindrical guide sleeve 24 surrounds draw horn 20 and is connected to an annular end cap 25 which is connected to an annular outer ram housing 27. A plurality of annular cylinders 29, 30 and 31 are mounted in a vertical stacked relationship within an annular bore 32 of outer ram housing 27. Cylinders 29–31 may be of the type which have a staggered operation, as shown and described in U.S. Pat. No. 5,626,048, the contents of which are incorporated herein by reference. Each of the cylinders has a respective piston 35, 36 and 37 independently movably mounted therein. An annular draw pad 40 is secured to an annular mounting ring 41 which is operatively engageable with lowermost piston 29. A usual annular cutting edge 49 is mounted on the lower end of outer ram 15.

Base 14 is indicated as being a fixed base but could be a fluidly supported base, if desired, in order to reduce the forces exerted thereon and to compensate for thermal expansion, without affecting the concept of the invention. A blank and draw retainer ring 44 is mounted on base 14 and secures a cup sleeve 45 within a cylindrical opening 46 formed in base 14. An annular blank and draw die 47 is secured by an annular die clamp 48 to base 14.

As indicated above, the components of first tooling station 3 are all well known in the art and could have other arrangements than that shown and described without affecting the concept of the invention.

In accordance with the invention, the elongated strip of sheet steel 5, which will have a longitudinal length greater than its width, is fed into tooling station 3, as shown by arrow A, FIG. 1. Due to the formation of strip 5, usually between a pair of calendering or press rolls, the strip will have a grain orientation, which is indicated diagrammatically at 51, which extends longitudinally along strip 5 and which is referred to as the grain direction. It is well known in the art that upon working of metal strip 5, the metal will flow in various directions and amounts depending upon the grain direction, as discussed in detail in U.S. Pat. No. 4,711,611. This is not a critical problem in the formation of a cylindrical can body, but does become a problem, as discussed above, when forming an elongated or non-cylindrical can body.

Figure 3A:
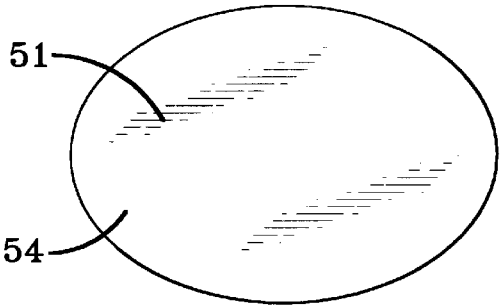
FIG. 3A is a top plan view showing a modified form of the flat blank disk of FIG. 3.
Figure 3:
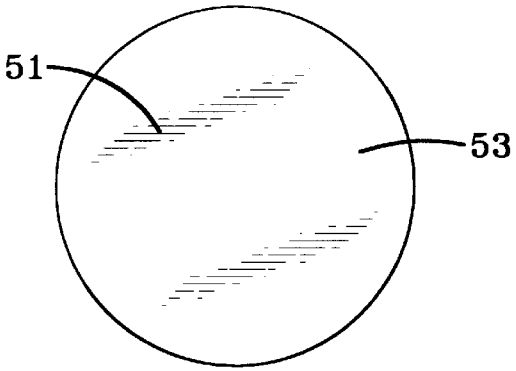
FIG. 3 is a top plan view showing one form of the initial flat blank disks formed by the tooling of FIG. 2.

First tooling station 3 will form one or preferably a plurality of disk-shaped blanks, indicated at 53 and 54 in FIGS. 3 and 3A, respectively. Blank 53 has a round disk-shaped configuration, whereas blank 54 has an oval configuration. These two blanks are merely representative of the various shapes that the initial disk-like blank member can have at the start of the forming operation. The blanks are formed in a usual manner by annular cut edge 49 which is mounted at the lower end of outer ram 15 by annular mounting ring 41. Continued downward movement of the inner ram will cause draw horn 20 to form the blank into a cup blank 55 having an elongated, preferably oval-shaped, bottom wall 56 and an integrally connected non-cylindrical side wall 57 (FIG. 4).

Figure 4:
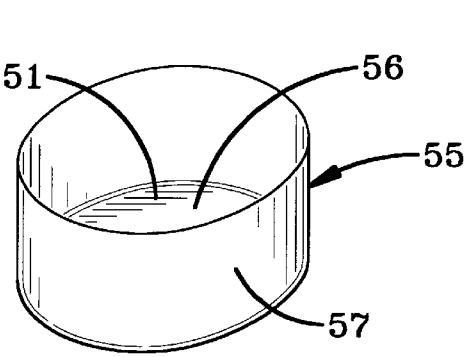
FIG. 4 is a perspective view showing the first stage can blank formed by the tooling of FIG. 2.

As shown particularly in FIGS. 3, 3A and 4, upon formation of the disk-like blanks 53 and 54 and body blank 55, the grain direction 51 will be known since the grain direction of the incoming strip is known. Also, the tooling components of first tooling station 3 will be arranged so that the grain direction will extend in a known direction; for example, when bottom wall 56 has an oval-shaped configuration such as shown for the blank of 3A, the grain direction preferably will be in the longitudinal direction or aligned with the major axis of the oval-shaped bottom wall. Can blanks 55 are moved out of tooling station 3 by individual output conveyors 6 and, in accordance with one of the features of the invention, will pass through orienting station 10. As shown particularly in FIGS. 1 and 5, output conveyors 6 will have a first longitudinal portion 6A and second longitudinal portion 6B, with portion 6B being formed with a plurality of holes 59 which communicate with a vacuum chamber (not shown) located below, so that a vacuum is applied thereto for securing can blanks 55 on the conveyor. Conveyor portion 6A is free of the vacuum and, preferably, will have a solid surface. These vacuum belts are well known in the art and, thus, are not described in further detail.

In accordance with one of the main features of the invention, can blanks 55, when deposited on conveyor 6, will move along belt 6 past a gate 60 which is located between a pair of spaced parallel guide rails 58A and 58B, which extend along the longitudinal edges of conveyor 6. An orienting post or obstruction 61 is spaced inwardly from guide rail 58A, so that when the elongated can blank 55 contacts obstruction 61 it will be rotated automatically, as shown by dot-dash lines in FIG. 5, due to the vacuum being applied to only a portion of the conveyor. The transverse distance between post 61 and guide rail 58B is just slightly greater than the length of the minor axis of can blank 55. This will ensure that blanks 55 will only pass through gate 60 with their major axis aligning with the longitudinal direction of movement of conveyor 6. This will ensure that the direction of the grain is known whether it is extending longitudinally along bottom wall 56 or in any other previous known direction. However, the important feature is that, due to the can blanks 55 always being in a known alignment direction after passing through the control gate 60, the direction of the grain, regardless of its particular direction with respect to the can, will also be known.

The properly oriented can blanks 55 then are moved along transfer conveyor 70 which also will have a vacuum hold-down to ensure that the can blanks maintain their previously oriented position toward second tooling station 4. The can blanks are then moved along input conveyors 8, as shown in FIG. 1, for subsequently entering the various work stations in tooling station 4.

Figure 6:
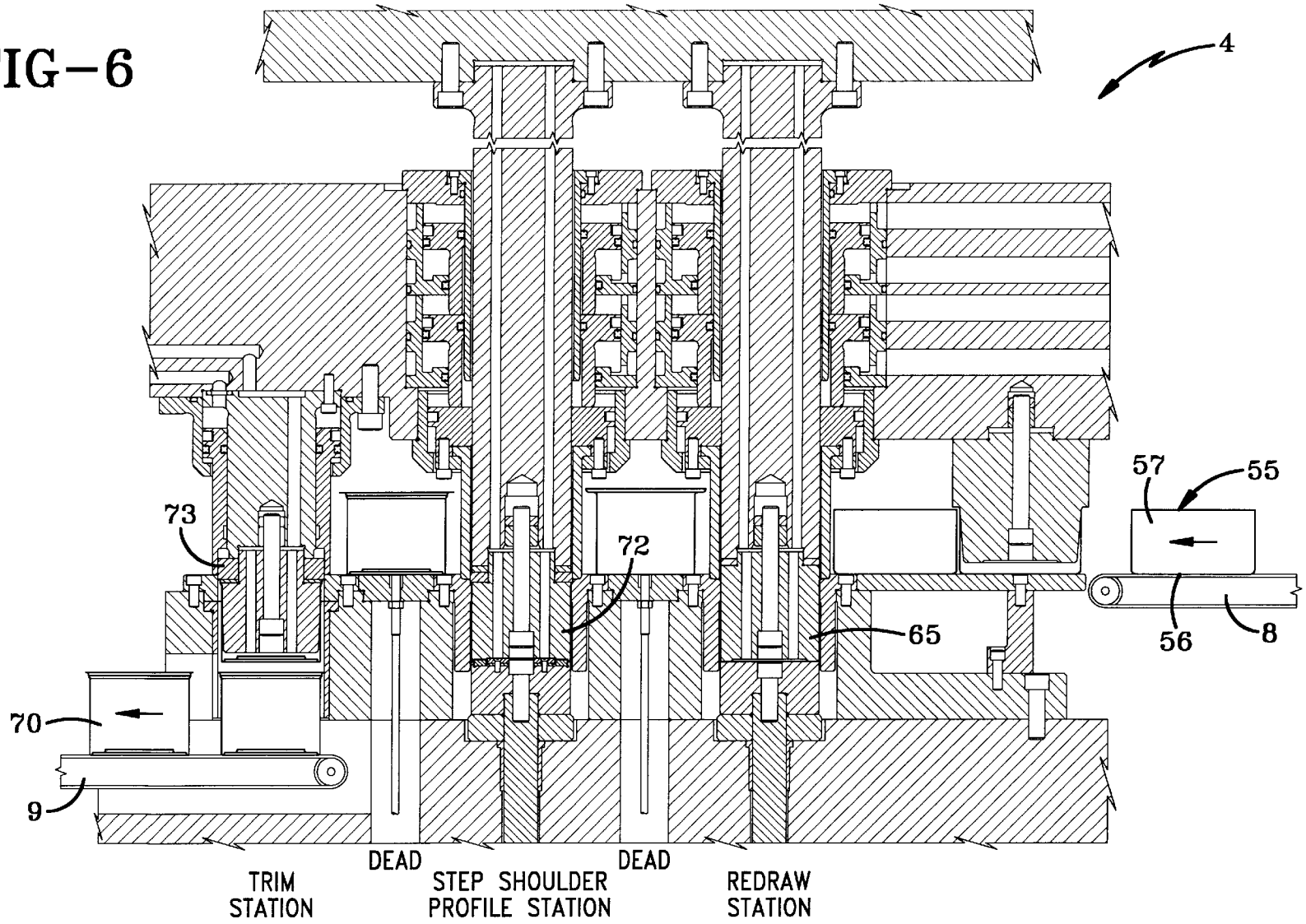
FIG. 6 is a diagrammatic sectional view showing the draw/redraw tooling at the right-hand end station of FIG. 1, which forms the can-shaped body as shown in FIG. 7.

Tooling station 4 is shown particularly in FIG. 6 and is of the same general type as shown and described in FIG. 2, with the various parts thereof being indicated by the same numerals, and thus many of the structural components are not described in further detail. The properly oriented incoming can blanks 55 enter a first redraw station of tooling station 4 where a draw horn 65 will engage the can blank and elongate the side walls thereof to the desired axial height, as shown by side wall 67 in FIG. 7, without thinning the metal thickness thereof by drawing the metal from the elongated-shaped bottom wall 56. Preferably, at the redraw station the final contour will be imparted to the finished can body, indicated at 70, which for many applications will have a generally elongated rectangular, somewhat oval configuration well known in the food industry for the packaging of meat products such as sold under the trademarks SPAM and TREET.

The partially formed can body is then transferred from the redraw station by usual press transfer mechanisms which will maintain the grain orientation thereof, to a step shoulder profile station, at which station the draw horn 72 will impart a step shoulder 74 thereto and a profile (not shown) to the final formed elongated bottom wall 75 thereof. The final can body 70 then may be acted upon at a trim station (left-hand side of FIG. 6) for removing an irregular outer edge which would be formed at step shoulder 74, before the finished can body is deposited onto output conveyors 9.

As is well known in the art and as shown in FIG. 6, can blank 55, which subsequently becomes finished can body 70, will move through a series of dead stations in the transfer press between the work stations performed by draw horns 65 and 72 and the trimming by cut ring 49 at the trim station.

However, in accordance with the invention, since the orientation of the grain in bottom wall 56 of can blank 55 is known when entering second tooling station 4, the effect or metal movement occurring during the redraw operation will be known even though it will move in different directions due to the non-cylindrical or circular shape thereof, which will enable the tooling to be properly designed and controlled. Should the elongated can blank 55 enter tooling station 4 without the direction of the grain being known, it is difficult to properly design the various forming dies and draw horns so that the metal moves in the desired and intended directions. This is especially important when the initial strip material 5 has printing thereon and, in particular, distorted litho, which naturally is distorted, into a desired final shape upon completion of the manufacturing process.

Figure 7:
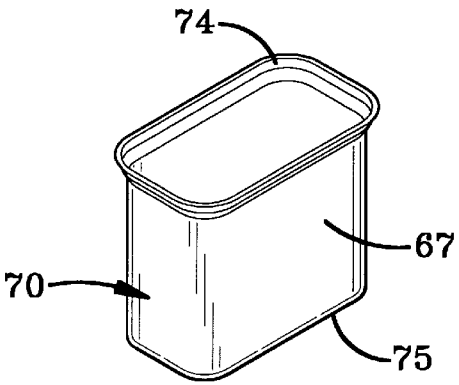
FIG. 7 is a diagrammatic view of the can-shaped body formed by the tooling of FIG. 6.
Figure 5:
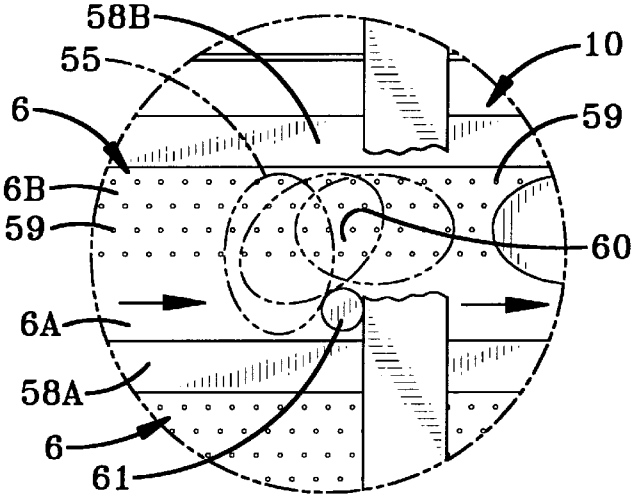
FIG. 5 is an enlarged fragmentary diagrammatic view of the encircled portion of FIG. 1 showing the method and apparatus for orienting the initial can blank as it moves through an orienting gate.

Although the preferred can body to be produced by the method and apparatus of the present invention will have an elongated generally rectangular configuration, as shown in FIG. 7, it could have other non-cylindrical configurations which can be manufactured satisfactorily, since due to its non-cylindrical and elongated configuration, it will automatically be oriented into a known direction as it passes through orienting station 10, as shown particularly in FIG. 5. Since the grain direction will be known, preferably in bottom wall 56 of the initially formed can blank 55, it will then be known after passing through gate 60. Even should this grain direction not extend longitudinally in line with its major axis, it could extend at a bias angle or perpendicular to the major axis without affecting the concept of the invention, since its direction will be known as it enters and is moved through the second tooling station 4.

Accordingly, the improved method and apparatus of the invention enables a non-cylindrical can body to be produced in a draw and redraw operation while always knowing the manner in which the metal will flow which, as indicated previously, is based upon its grain direction, thereby enabling the tooling to be better designed and controlled than heretofore possible and, most importantly, does not require any device or indentation to be formed in the non-cylindrical can for orienting the grain thereof, as is presently being accomplished by a dimple in the bottom wall of the can blank, which can present problems.

Accordingly, the improved method and apparatus for making a non-cylindrical can body is simplified, provides an effective, safe, inexpensive, and efficient device and method which achieves all the enumerated objectives, provides for eliminating difficulties encountered with prior devices and methods, and solves problems and obtains new results in the art.

In the foregoing description, certain terms have been used for brevity, clearness and understanding; but no unnecessary limitations are to be implied therefrom beyond the requirement of the prior art, because such terms are used for descriptive purpose and are intended to be broadly construed.

Moreover, the description and illustration of the invention is by way of example, and the scope of the invention is not limited to the exact details shown or described.

Having now described the features, discoveries and principles of the invention, the manner in which the improved method and apparatus for making a non-cylindrical can body is constructed and used, the characteristics of the construction, and the advantageous, new and useful results obtained, the new and useful structures, devices, elements, arrangements, parts, combinations and method steps, are set forth in the appended claims.

We claim:

1. Method for making a non-cylindrical can body having a bottom wall and a side wall including the steps of:

A. providing an elongated strip of sheet metal having a uniform thickness and having a known grain direction;

B. forming a flat blank from the metal strip with the grain direction of said blank being known;

C. forming the flat blank into an elongated can blank having generally major and minor axes and having a known grain direction at a first tooling station, said can blank having an annular side wall terminating in a flangeless top edge and an integral oval-shaped bottom wall, said side and bottom walls each with a thickness substantially equal to the thickness of the strip of sheet material;

D. moving said elongated can blank from the first tooling station toward a second tooling station;

E. orienting said elongated can blank in a known direction with respect to the grain and maintaining control of and knowing the grain direction of said oriented can blank when moving the can blank between said first and second tooling stations;

F. redrawing said elongated can blank into the can body at the second tooling station while maintaining and knowing the grain direction in the bottom wall of the can blank as it moves through said second tooling station; and G. reducing the major and minor axes of the can blank and increasing the axial height of the can blank without substantially thinning the thickness of the side and bottom walls when performing Step F.

2. The method defined in claim 1 including the step of providing the elongated strip of sheet material having a longitudinal length greater than its width with the grain direction being in the longitudinal direction.

3. The method defined in claim 1 including the step of forming the flat blank of step B into a round disk-shaped blank.

4. The method defined in claim 1 including the step of forming the flat blank of step B into an oval-shaped blank.

5. The method defined in claim 1 wherein the step of moving the elongated can blank of step D is performed by a conveyor.

6. The method defined in claim 5 including the step of applying a vacuum to only a portion of the conveyor to maintain the elongated can blank in the predetermined position when moving between the first and second tooling stations.

7. The method defined in claim 6 wherein the step of orienting the elongated can blank is performed by passing said can blank through an orienting gate having an obstruction which contacts the can blank and prevents said can blank from passing beyond said obstruction unless the major axis of the can blank aligns generally with the direction of movement of the conveyor.

8. The method defined in claim 1 including the step of forming the elongated can blank formed by Step C with an axial height less than the axial height of the can body formed by Step F.

9. The method defined in claim 1 including the steps of moving the can blank through a series of work stations at the second tooling station while maintaining the same grain orientation as said can blank moves through said work stations.

10. The method defined in claim 9 wherein the redrawing of the cup blank in Step F includes forming a stepped shoulder surrounding an open end of the can blank and providing a profile to the bottom wall.

11. The method defined in claim 1 wherein the redrawing of the cup blank in Step F includes forming the can body into a substantially rectangular configuration with spaced end walls and spaced side walls.

12. Apparatus for forming a non-cylindrical can body having a side wall and an integral bottom wall from a flat strip of sheet metal having a known grain direction, including:

first tooling means for forming a flat blank from the flat strip with the grain direction extending in the known direction;

second tooling means for forming the flat blank into an elongated oval-shaped can blank having an elongated oval-shaped bottom wall with major and minor axes and a side wall, with said bottom wall having the grain extending in the known direction;

third tooling means for redrawing the oval-shaped can blank into the non-cylindrical can body and maintaining the grain direction extending in the known direction in the bottom wall of said can body;

means for moving the oval-shaped can blank from the first and second tooling means to the third tooling means; and means for orienting the oval-shaped can blank so the grain is extending in the known direction and maintaining control of the oriented can blank prior to redrawing said can blank in the third tooling means.

13. The apparatus defined in claim 12 in which the orienting means includes gate means having a predetermined size opening approximately equal to the minor axis of the oval shaped can blank, thereby permitting the can blank to pass therethrough only in a predetermined orientation which is in a known relationship to the known grain direction of the bottom wall.

14. The apparatus defined in claim 13 in which the moving means includes a conveyor having a first longitudinal portion adapted to have a vacuum applied thereto and a second longitudinal portion free of any vacuum.

15. The apparatus defined in claim 14 in which the gate means includes an obstruction located adjacent the second conveyor portion.

16. The apparatus defined in claim 12 in which the third tooling means includes a redraw station for elongating the axial height of the side wall of the can blank, a step profile station for forming a stepped shoulder adjacent an open end of the can blank and for imparting a profile on the bottom wall of said can blank.

* * * * *